US007032657B2

(12) United States Patent
Barbary

(10) Patent No.: US 7,032,657 B2
(45) Date of Patent: Apr. 25, 2006

(54) EFFERVESCENCE KEEPER

(76) Inventor: Patrick Barbary, 730 E. Strawbridge Ave., Suite 200, Melbourne, FL (US) 32901

( * ) Notice: Subject to any disclaimer, the term of this patent is extended or adjusted under 35 U.S.C. 154(b) by 461 days.

(21) Appl. No.: 10/249,343

(22) Filed: Apr. 2, 2003

(65) Prior Publication Data

US 2004/0195198 A1 Oct. 7, 2004

(51) Int. Cl.
*F28F 7/00* (2006.01)

(52) U.S. Cl. ..... 165/185; 165/142

(58) Field of Classification Search ..... 165/185, 165/86, 109.1, 128, 132, 142, 186; 62/293; 215/200
See application file for complete search history.

(56) References Cited

U.S. PATENT DOCUMENTS

| | | | | |
|---|---|---|---|---|
| 1,467,462 | A * | 9/1923 | Von Codelli | 62/46.1 |
| 2,145,473 | A * | 1/1939 | Billner | 299/15 |
| 2,746,265 | A * | 5/1956 | Mills | 62/4 |
| 2,805,846 | A * | 9/1957 | Dewan | 261/121.1 |
| 2,835,480 | A * | 5/1958 | Perez | 165/104.21 |
| 4,458,584 | A * | 7/1984 | Annese et al. | 99/323.1 |
| 4,723,670 | A * | 2/1988 | Robinson et al. | 215/228 |
| 4,735,063 | A * | 4/1988 | Brown | 62/293 |
| 5,635,232 | A * | 6/1997 | Wallace | 426/397 |

* cited by examiner

*Primary Examiner*—Teresa J. Walberg
(74) *Attorney, Agent, or Firm*—Joel I. Rosenblatt

(57) ABSTRACT

An effervescence keeper is shown as an elongated body for placement into an open container having a quantity of carbonated liquid. The effervescence keeper includes a stopper for supporting the effervescence keeper on the neck of the container and adjusting holes or slots for adjusting the position of the stopper relative to its displacement along the longitudinal axis of the effervescence keeper.

14 Claims, 3 Drawing Sheets

EFFERVESCENCE KEEPER

BACKGROUND OF INVENTION

Gas dissolved in a liquid has been a known phenomena since the first vintage of wines from grape and the generation of carbon dioxide gas from the fermentation process. The retention of the carbon dioxide gas in its liquid dissolved state, has been a challenge from the first vintage of champagne, where the dissolved gas was the by product of the fermentation process, to current processes where gas is added, as in the case of soft drink production, and then the container is sealed to prevent gas effervescence.

Refrigeration or holding a liquid containing dissolved gas in a cooled state relative to ambient, is another technique for reducing the rate of effervescence, it being known that the cooler the liquid, the less energy available for boil off or for effervescence of the dissolved gas.

While the prior art contains many examples of stoppers or seals for sealing the opening of a container, for example a bottle of an artificially carbonated beverage or a bottle of champagne, it has been well recognized that the carbonation is best kept by the combination of the plug, effectively sealing in the effervesced gas, and refrigeration, to lower the energy level of the contained liquid. However, it has been recognized that while an effective plug may retard effervescence, refrigeration without a plug closing or sealing the opening of a container containing a carbonated to ambient, will not effectively retard effervescence and the carbonated beverage may be expected to quickly become flat.

Another problem with plugs used for sealing container is the seals wear with the result that with each use, the rate of effervescence of the dissolved gas increases.

Another significant problem with plugs is they must be sized to a container and at least several different sized plugs must be kept to accommodate sized bottles or at least several of the same size where several bottles of champagne or other carbonated beverage are open at the same time. Accordingly, a problem faced by the prior art is an effective way to retard effervescence without resort to a container plug for sealing the outlet of a container for the carbonated beverage.

SUMMARY OF INVENTION

As shown herein, according to the principles of the disclosed invention, a device and method for retarding the effervescence of a gas dissolved in a liquid, may be used in an open container, exposed to ambient pressure and according to the best mode of using the invention, exposed to an ambient temperature about the same temperature of the liquid or a lower temperature. A preferred embodiment is as shown in the form of a hollow elongated body, such as for example a cylinder, shaped to extend into a container and sized relative to the size of the opening. The device may include a stop having a dimension larger than the opening to prevent the device from falling into the liquid and which may be capable of adjustment over the longitudinal axis of the for adjusting depth of insertion of the elongated body into the container.

The shape of the stop may be varied consistent with the disclosed principles of the invention and without departing from the disclosed invention.

What is shown according to the disclosed inventive principles is an effervescence keeper for suppressing the effervescence of a dissolved gas from a liquid, into an air space within an open container, open to an ambient environment, comprising, a. first means for conducting heat; second means for holding the first means suspended within an air space in an open container open to ambient and holding a quantity of liquid containing a dissolved gas; whereby the first means conducts heat from the air space to an ambient. In accordance with the inventive principles, the ambient is at a temperature approximately the same, or lower than the quantity of liquid and the second means includes means for adjusting the extent of the first means in the air space or the distance between the first means and the surface level of the quantity of liquid. Alternatively, according to the disclosed inventive principles, the second means includes means for variably adjusting the extent of the first means in the air space or the distance between the first means and the surface level of the quantity of liquid.

The effervescence keeper as disclosed is for placement in an open container holding a quantity of a liquid with an air space above the liquid and with the liquid containing a dissolved gas. The effervescence keeper is used for preventing or suppressing or for retarding the effervescence of the dissolved gas and comprises an elongated heat conducting body, for having a longitudinal axis; a stop mounted on the elongated body, extending in a direction at an angle to the longitudinal axis for supporting the elongated body on the open container. In a preferred embodiment, the elongated body is hollow and may include openings displaced from each other relative to the longitudinal axis for receiving the stop and adjusting the position of the stop relative to its displacement along the longitudinal axis. According to the disclosed inventive principles, the elongated body may have a threaded surface in a displacement along its longitudinal axis and the stop may includes a threaded surface for cooperation with the elongated body threaded surface for variably adjusting the position of the stopper relative to its displacement along the longitudinal axis.

The container holding the quantity of liquid and dissolved gas may be placed in an ambient environment at an ambient temperature approximately about or less than the temperature of the quantity of liquid, such as for example, a refrigeration apparatus. The effervescence keeper, disclosed in a preferred embodiment as an elongated heat conducting body having a longitudinal axis with a stop mounted extending in a direction at an angle to the longitudinal axis to support the elongated body on the container opening, is placed in the air space in the open container. The elongated body may be hollow to increase its surface area and rate of conduction of heat from the air space to the ambient and the stop may include additional radiating surfaces to increase the conduction of heat from the air space in the container to ambient. The elongated body may be cylindrical or shaped in other geometric shapes or of a varying configuration, without departing from the disclosed principles of the invention.

What is disclosed is a method for preserving from effervescence, a dissolved gas in a liquid within an open container comprising the steps of, placing an elongated heat conducting body in the container to the level of the liquid; and placing the container in an ambient temperature at approximately about or lower than the temperature of the liquid.

A preferred embodiment, as disclosed, would be used according to the disclosed inventive principles, after a bottle or other container of liquid containing a dissolved gas, is opened and after some of the liquid is dispensed, a part of the original volume of the carbonated liquid is left over for a later period with an air space above. A preferred embodiment, in the form of an elongated body, for example a hollow cylinder is inserted into the bottle opening and as far as down to but not touching the liquid. The stop located proximate the bottle or container opening and supporting the effervescence keeper on the container opening may be adjustable to prevent the effervescence keeper from extending further into the bottle or container. The dimension of the effervescence keeper apparatus orthogonal to its longitudinal axis may be shaped to extend its surface area inside the container, for example by using a hollow shape or enlarging it to fill the air space inside the container and its ability to conduct heat from the interior of the bottle or container to its opening and to ambient.

Placed inside the bottle or container, the apparatus radiates heat from inside the container to the ambient, kept at about the same temperature as the liquid or at a lower temperature. The radiation of the heat from the open container, keeps the air space of the container or bottle, at the same temperature as the ambient and at about the same or lower temperature than the liquid.

BRIEF DESCRIPTION OF SEQUENCES

Figure 3:
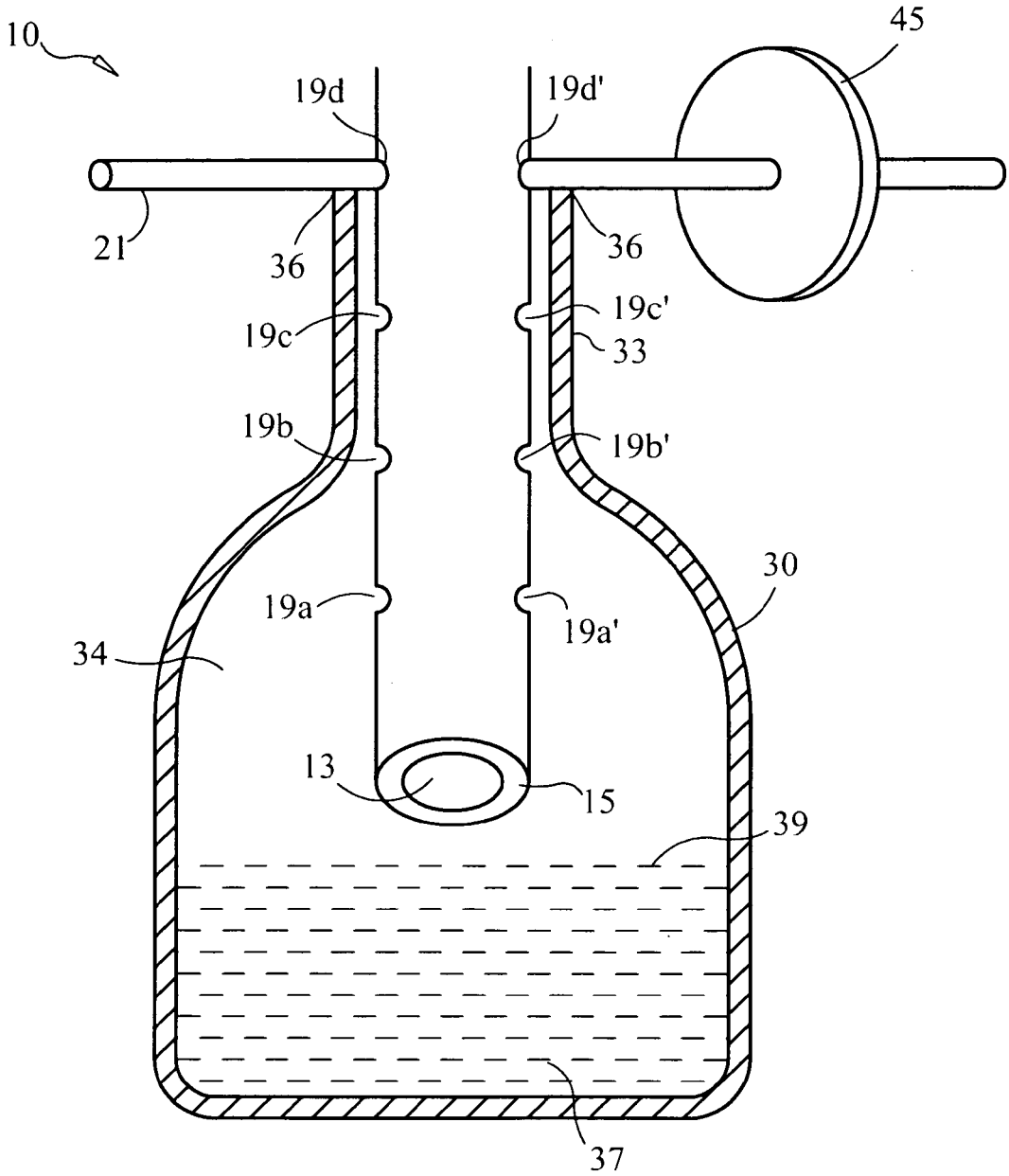
FIG. 3, shows a preferred embodiment of the effervescence keeper with a screw thread cooperating with a threaded stop for variably adjusting the extent of the effervescence keeper, into an open container of carbonated liquid.
Figure 4:
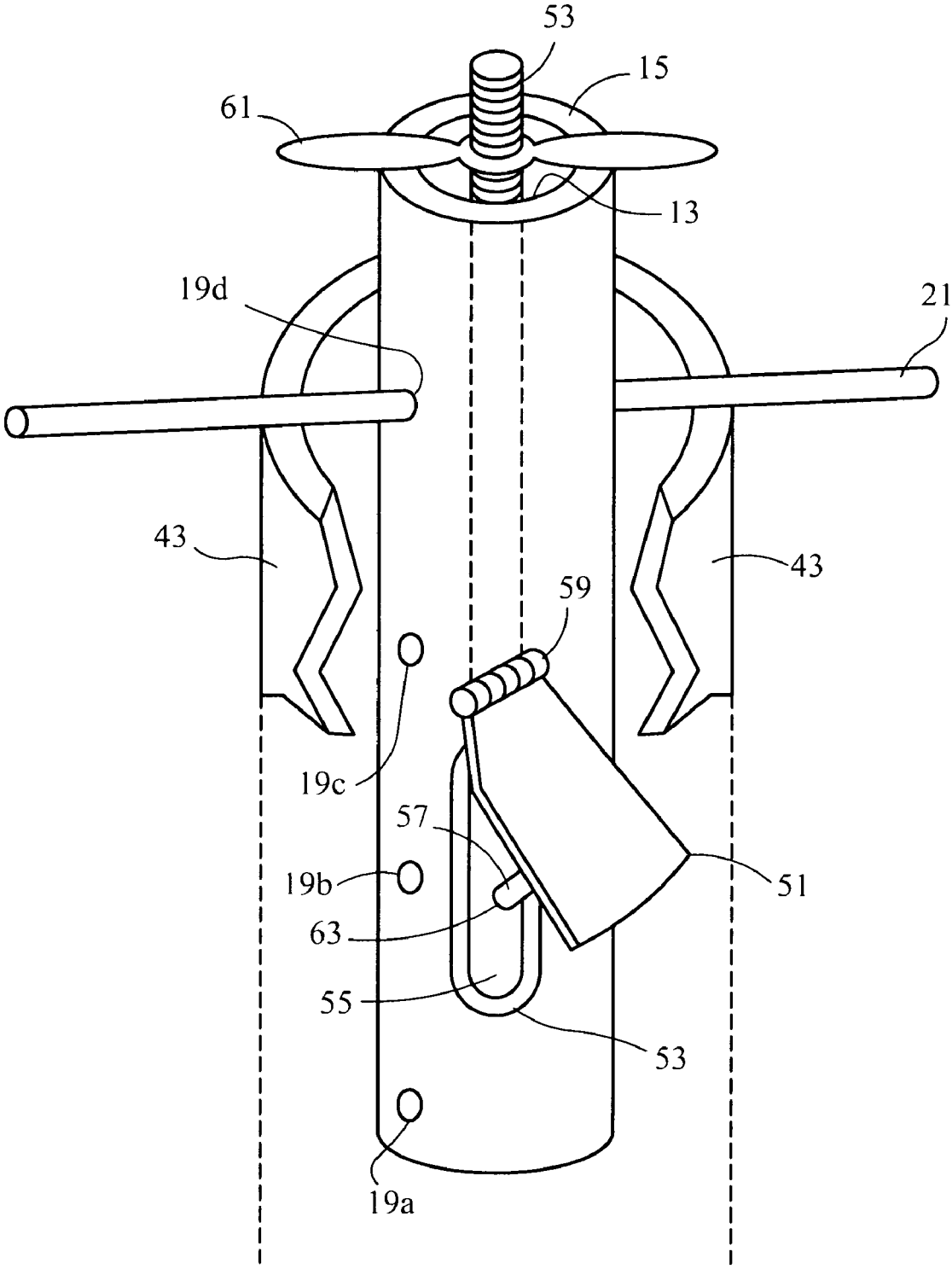

FIG. 4, shows a preferred embodiment of the effervescence keeper with an adjustable radiator which may be used to expand the surface area of effervescence keeper, and to expand the coverage of the effervescence keeper over the surface area of the carbonated liquid, after the effervescence keeper is place in a container, for example a container with an opening smaller that the container body holding the carbonated liquid, such as for example, the container shown in FIG. 3.

DETAILED DESCRIPTION

Figure 1:
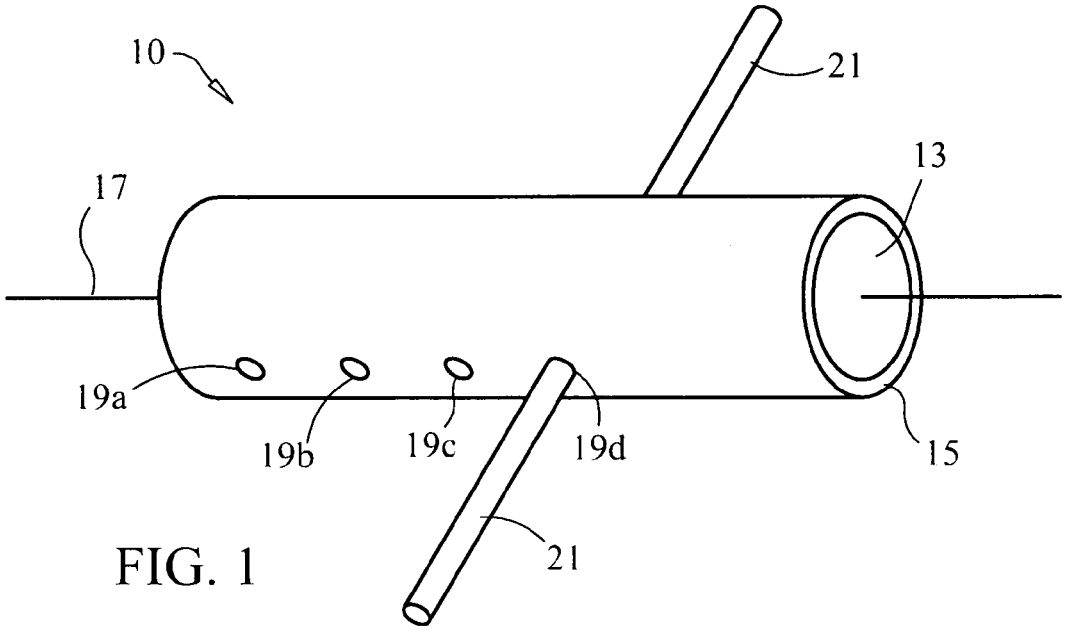
FIG. 1, shows the effervescence keeper according to a preferred embodiment

A preferred embodiment of the effervescence keeper, according to the disclosed inventive principles is shown in FIG. 1, as an elongated body, shown generally by numeral 10, and in a preferred embodiment as a cylinder with a hollow interior 13 defined by the annular wall 15 extending the length of the longitudinal axis 17. Arranged along the longitudinal axis 17 and radially therefrom, a series of holes 19*a* to 19*d* are shown arranged in diametric pairs, with the diametric opposite to each of the holes 19*a*' to 19*d*', not shown but as would be understood to those skilled in the art, and as partially shown in FIG. 2.

A stop 21, shown in the preferred embodiment in the shape of a rod is sized to fit through the holes 19*a* to 19*d* and matching holes 19*a*' to 19*d*', the respective diametric opposite hole. The position of the stop 21 may be adjusted by insertion into holed 19*a,a;* to 19*d,d*', spaced along the longitudinal length 17 of the hollow cylinder 10*m* to adjust the length or extent of the effervescent keeper allowed to extend into the open bottle or container with the carbonated liquid, as shown in FIG. 2.

Figure 2:
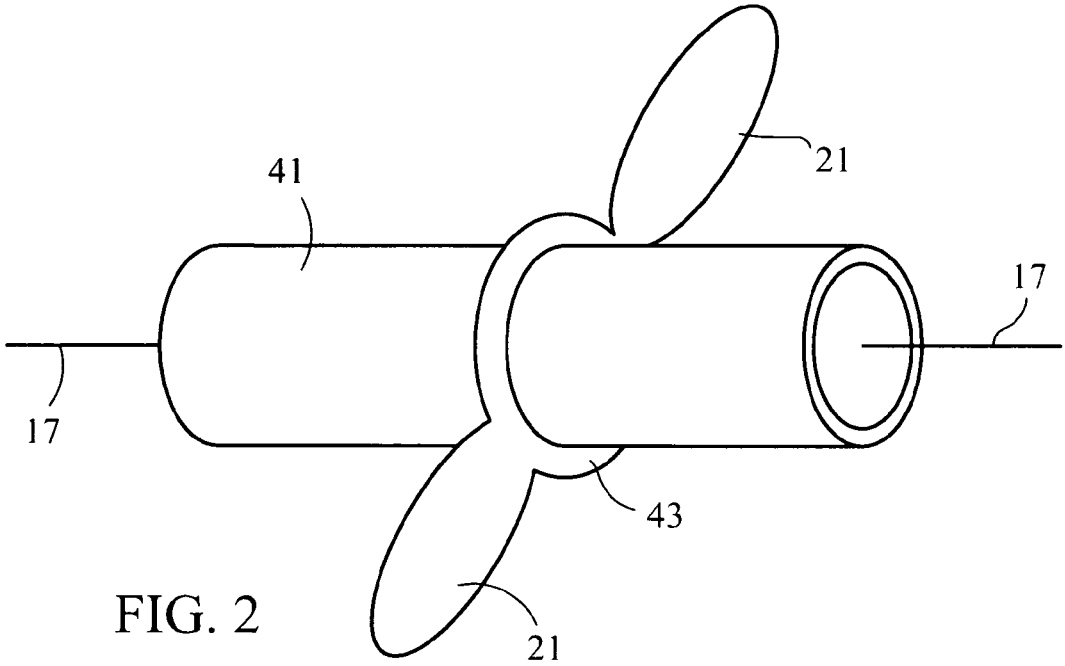
FIG. 2, shows the effervescence keeper used in a container partially filled with a carbonated liquid.

The method of using the effervescence keeper, according to a preferred embodiment and a best mode, is shown with reference to FIG. 2. As shown therein, a container, for example a bottle, is shown in cross section generally by numeral 30. The effervescence keeper 10, as disclosed with reference to FIG. 1, is shown inserted into the narrow part or neck 33 of container 30, with a stop 21 shown inserted through a stop hole 19*d,* 19*d*', for example. The effervescence keeper 10 is positioned above the liquid 37 and above its surface 39, in the air space 34, by use of the stop 21, supporting the effervescence keeper 10, on opening 36 of the container 30. As would be understood by those skilled in the art, the number of, or placement of the adjustment holes, 19*a,a*' to 19*d,d*', for example, may be varied to alter the preciseness of the adjustment possible. Where, for example, the surface 39 of the liquid 37 is higher, as in the case where less liquid is dispensed from the bottle, the stopper 21 may be placed in a hole, further along the longitudinal axis, in holes 19*a,* 19*a*' to 19*c,* 19*c*', for example to raise the effervescence keeper and position it above a higher surface level 39.

In FIG. 3, is shown an alternate preferred embodiment of the effervescence keeper of FIG. 1, with the same numerals showing the same or equivalent parts and with a screw thread 41 cooperating with a threaded collar 43 mounted on stop 21 and cooperatively engaged with threads 41, as would be known to those skilled in the art. By turning stopper 21, the position of collar 43 is moved relative to its position along the longitudinal axis 17 so the length of the effervescence keeper 10 can be variably adjusted relative to the surface level 39 of the carbonated liquid 37, remaining in the container 33. as shown in FIG. 2.

Once a bottle or other container of a carbonated beverage is opened and some of the contents dispensed, leaving an evacuated air space, 34. the effervescence keeper may be placed in the open unsealed container, with the effervescence keeper extending to the level 39 of the remaining liquid 37. The surface area of the effervescence keeper 10 serves as a conductor of heat from the interior air space 34 of the container 33, above the level 39 of the liquid to an ambient temperature which may be the interior of a refrigerator and which is at about the same temperature of the liquid 37 or a lower temperature. To improve heat conduction, radiating surfaces such as for example disk 45 may be added to the stop 21 or to any other surface of the effervescence keeper, for example the effervescence keeper 10 as shown in FIG. 4. The surface area of the effervescence keeper 10, including any radiating surfaces such as disk 45 or the adjustable radiator 51, as examples, serves to conduct heat away from the volume of the air space in the container 30 above the liquid 37, to maintain its temperature at the ambient or about the same as the liquid 37 or cooler and preventing or retarding or suppressing the continuing effervescence of gas dissolved in the liquid 33, across the surface level 39 of the liquid 37, representing a boundary level between the liquid 37 and air space 34, in the container 30.

As for many containers, where the neck 33 or opening into the container is narrower than the body of the container holding the liquid, diameter or cross section size of the effervescence keeper 10, must be restricted to fit into the container and once in the container, would then cover a part of the surface are 39, extending to the cross section of effervescence keeper 10 or at most, about the area of the opening 36 serving as the neck of the container. To expand the surface area of the effervescence keeper over the surface area of the surface 39, the effervescence keeper may be made with adjustable radiators, such as for example radiator 51 shown in FIG. 4. Once placed in the container 43, the radiator may be adjusted to extend radially from the interior 13 of the effervescence keeper 10, and over the surface of a liquid, not shown but understood to be within container 43, as for example by surface 39 in FIG. 3, and extending radially outward from the annular wall 15.

In a preferred embodiment, the adjustable radiators may be adjusted to adjust the area of the effervescence keeper 10, by means of threaded rod 53 which may be displaced by means of adjuster 61 supporting the threaded rod 53 on the annular wall 15. Raising or lowering the rod 53, as shown in a preferred embodiment, causes strut 57, pivotally engaged to rod 53 at pivot joint 63 to fold inward or be pushed outward, forcing the adjustable radiator 51 to be displaced about hinge 59, to vary the area of the liquid under the coverage of the adjustable radiator 51. As would be apparent and known to those skilled in the art, the particular means or method chosen for expanding the coverage of the effervescence keeper over the liquid surface area in a container, may be any means known or understood by those skilled in the art. According to the disclosed invention and its inventive principles and as would be known to those skilled in the art, the number or shape or size of the radiators or size or arrangement of a means for adjusting the area of the liquid 39, covered by the effervescence keeper 10, may be varied and any suitable means now known or later discovered, may be used as would be known to those skilled in the art, without departing from the disclosed inventive principles.

As would be apparent to those skilled in the art, there are other equivalent structures or means for providing the functions shown disclosed herein. Without limitation, such equivalents would be any structure which provides an surface opposed to the liquid surface 39, such as an inverted umbrella or a fan opening into a planar surface, positioned opposed to the liquid surface 39, or structure for adjusting the height of the effervescence keeper above the surface 39 of the liquid.

In conducting heat away from the surface 39 of the liquid 37, the deployment of adjustable radiators, for example the adjustable radiator 51, would decrease the air space between the surface area 30 and the effervescence keeper 10 and contribute to the transfer of heat from the surface area to the ambient.

The drawings shown herein in connection with the description of a preferred embodiment, are drawn to show and disclose the concept of the invention and the inventive principles and are not scale or shop drawing and are not intended to be. The drawings are illustrative intended to provide sufficient information for one skilled in the art to make and use the invention.

The invention claimed is:

1. An effervescence keeper for suppressing the effervescence of a dissolved gas from liquid, into an air space within an placed in an ambient environment comprising, a. first means for conducting heat, b. second means for holding said first means suspended within an air space in a open container holding a quantity of liquid containing a dissolved gas, whereby said first means conducts heat from said air space to an ambient, and wherein said second means includes means for adjusting the extent of said first means in said air space or the distance between said first means and the surface level of said quantity of liquid.

2. The effervescence keeper of claim 1, wherein said ambient is at a temperature approximately the same, or lower than said quantity of liquid.

3. The effervescence keeper of claim 1, wherein said second means includes means for variably adjusting the extent of said first means in said air space or the distance between said first means and the surface level of said quantity of liquid.

4. The effervescence keeper of claim 1, wherein said first means includes, c. third means for adjusting the area of said first means.

5. The effervesce keeper of claim 4, wherein said third means includes means for expanding said area of said first means over the surface level of said quantity of liquid.

6. A effervescence keeper for placement in an open container holding a quantity of a liquid containing a dissolved gas and for retarding the effervescence of the dissolved gas, comprising, a elongated heat conducting body having a longitudinal axis; and a stop mounted on said elongated body, extending in a direction at an angle to said longitudinal axis for supporting said elongated body on said open container, and wherein said elongated body has a threaded surface displaced along its longitudinal axis and said stop includes a threaded surface for cooperation with said elongated body threaded surface for variably adjusting the position of said stop relative to its displacement along said longitudinal axis.

7. A method for preserving from effervescence, a dissolved gas in a liquid within an open container comprising the steps of, a. placing an elongated heat conducting body in said open container to the proximate level of said liquid; and b. placing said container in an ambient temperature at approximately about the temperature of said liquid.

8. The method of claim 7, including the step of adjusting the extent of said heat conducting body to approximately the level of said liquid.

9. The method of claim 7, including the step of extending an adjustable radiator over the surface of said liquid.

10. An effervescence keeper for suppressing the effervescence of a dissolved gas from a liquid into an air within an open container placed in an ambient environment comprising a. first means for conducting heat;

b. second means for holding said first means suspended within an air space in a open container holding a quantity of liquid containing a dissolved gas; whereby said first means conducts heat from said air space to an ambient and wherein said means includes, c. third means for adjusting the area of said first means.

11. The effervescence keeper of claim 10, wherein said third means includes means for expanding said area of said first means over the surface level of said quantity of liquid.

12. An effervescence keeper for placement in an open container holding a quantity of a liquid containing a dissolved gas and for retarding the effervescence of the dissolved gas, comprising, a elongated heat conducting body having a longitudinal axis; and a stop mounted on said elongated body, extending in a direction at an angle to said longitudinal axis for supporting said elongated body on said open container, and wherein said elongated body includes openings displaced from each other relative to said longitudinal axis for receiving said stop and adjusting the position of said stop relative lo its displacement along said longitudinal axis.

13. The effervescence keeper of claim 12, wherein said elongated body includes an interior space.

14. An effervescence keeper for placement in an open container holding a quantity of an liquid containing a dissolved gas and for retarding the effervescence of the dissolved gas, comprising, a elongated heat conducting body having a longitudinal axis; and a stop mounted on said elongated body, extending in a direction at an angle to said longitudinal axis for supporting said elongated body on said open container, and wherein said elongated heat conducting body includes, at least one adjustable radiator, a rod mounted for displacement along said longitudinal axis, and said adjustable radiator is pivotally mounted to said rod and said elongated body for varying its displacement over the surface of said liquid.

* * * * *